US010405584B2

(12) United States Patent
Chen et al.

(10) Patent No.: US 10,405,584 B2
(45) Date of Patent: Sep. 10, 2019

(54) ATOMIZING DEVICE AND ELECTRONIC CIGARETTE HAVING SAME

(71) Applicant: SHENZHEN FIRST UNION TECHNOLOGY CO., LTD., Shenzhen (CN)

(72) Inventors: Hongbin Chen, Shenzhen (CN); Yuqin Li, Shenzhen (CN); Yonghai Li, Shenzhen (CN); Zhongli Xu, Shenzhen (CN)

(73) Assignee: SHENZHEN FIRST UNION TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/702,816

(22) Filed: Sep. 13, 2017

(65) Prior Publication Data

US 2018/0070639 A1 Mar. 15, 2018

(30) Foreign Application Priority Data

Sep. 14, 2016 (CN) ..... 2016 2 1057505 U

(51) Int. Cl.
*A24F 13/00* (2006.01)
*A24F 47/00* (2006.01)
(Continued)

(52) U.S. Cl.
CPC ..... *A24F 47/008* (2013.01); *F22B 1/281* (2013.01); *H05B 6/105* (2013.01)

(58) Field of Classification Search
CPC ..... A24F 47/008
(Continued)

(56) References Cited

U.S. PATENT DOCUMENTS 5,878,752 A * 3/1999 Adams ..... A24F 47/008 131/194
5,902,501 A * 5/1999 Nunnally ..... A24F 47/008 219/263
(Continued)

FOREIGN PATENT DOCUMENTS

CN 203618764 U 6/2014
CN 104095291 A 10/2014
(Continued)

OTHER PUBLICATIONS

European Search Report.

*Primary Examiner* — Phuong K Dinh
(74) *Attorney, Agent, or Firm* — IPro, PLLC; Na Xu

(57) ABSTRACT

The present disclosure discloses an atomizing device for an electronic cigarette and an electronic cigarette having the same. The atomizing device includes a housing and an electromagnetic induction heating device disposed in the housing. The electromagnetic induction heating device includes a plurality of electromagnetic induction coils and an induction heater, the plurality of electromagnetic induction coils being disposed on the periphery of the induction heater, the induction heater is configured to generate a corresponding vortex in a magnetic field which is generated by the plurality of electromagnetic induction coils, and the induction heater is configured to radiate heat from the periphery to heat and bake tobacco materials in the electromagnetic induction heating device. The atomizing device for an electronic cigarette according to the present disclosure has a high heating efficiency and is capable of sufficiently decomposing tobacco materials.

14 Claims, 6 Drawing Sheets

(51) Int. Cl.
*F22B 1/28* (2006.01)
*H05B 6/10* (2006.01)

(58) Field of Classification Search
USPC ..... 131/328–329
See application file for complete search history.

(56) References Cited

U.S. PATENT DOCUMENTS

| | | | | |
|---|---|---|---|---|
| 2017/0188636 | A1* | 7/2017 | Li | A24F 47/008 |
| 2018/0214645 | A1* | 8/2018 | Reevell | A61M 11/042 |
| 2018/0289071 | A1* | 10/2018 | Cadieux | A24F 47/008 |

FOREIGN PATENT DOCUMENTS

| | | | |
|---|---|---|---|
| EP | 0703735 | A1 | 4/1996 |
| GB | 2533080 | * | 6/2016 |
| WO | 2015177045 | A1 | 11/2015 |

* cited by examiner (a)

(b)

ATOMIZING DEVICE AND ELECTRONIC CIGARETTE HAVING SAME

CROSS-REFERENCE TO RELATED APPLICATIONS

The present disclosure claims priority to Chinese Patent Application No. 201621057505.2, filed with the Chinese Patent Office on Sep. 14, 2016, titled "ATOMIZING DEVICE AND ELECTRONIC CIGARETTE HAVING SAME", the entire contents of which are incorporated herein by reference.

TECHNICAL FIELD

The present disclosure relates to the technical field of electronic cigarettes, and in particular, relates to an atomizing device and an electronic cigarette having the same.

BACKGROUND

As a kind of hobby and special merchandise, cigarettes are popular among people. However, tar, carbon monoxide and the like substances contained in the cigarette are hazardous to the health of people. Especially, the tar contains over ten cancer-inducing ingredients, which greatly influence the human health. At present, governments all over the world have gradually prohibited smoking cigarettes (tobaccos) in the public places. However, it is very painful and hard for addicted smokers to never quit cigarettes. Therefore, many cigarette substitutes are emerging in the market, for example, cigarette cessation tablets, electronic cigarettes and the like.

The electronic cigarettes generate smoke by atomizing cartridges, such that users smoke and feel as they are smoking real cigarettes because the electronic cigarettes have a similar appearance as the real cigarettes and create similar taste as the real cigarettes. In addition, since the electronic cigarettes contains no tar, suspension particles and the like hazardous substances, the electronic cigarettes are more and more widely welcomed by the users.

Conventional electronic cigarettes mostly employ nickel-chromium heating element to heat the cartridges.

SUMMARY

An embodiment of the present disclosure provides an atomizing device for an electronic cigarette. The atomizing device includes a housing and an electromagnetic induction heating device disposed in the housing; wherein the electromagnetic induction heating device includes a plurality of electromagnetic induction coils and an induction heater, the plurality of electromagnetic induction coils being disposed on the periphery of the induction heater, the induction heater is configured to generate a corresponding vortex in a magnetic field which is generated by the plurality of electromagnetic induction coils, and the induction heater is configured to radiate heat from the periphery to heat and bake tobacco materials in the electromagnetic induction heating device.

Another embodiment of the present disclosure provides an electronic cigarette. The electronic cigarette includes a power supply assembly and an atomizing device that are connected to each other; the atomizing device including:

a housing; and an electromagnetic induction heating device, disposed in the housing;

wherein the electromagnetic induction heating device includes a plurality of electromagnetic induction coils and an induction heater, the plurality of electromagnetic induction coils being disposed on the periphery of the induction heater, the induction heater is configured to generate a corresponding vortex in a magnetic field which is generated by the plurality of electromagnetic induction coils, and the induction heater is configured to radiate heat from the periphery to heat and bake tobacco materials in the electromagnetic induction heating device; and wherein the power supply assembly including a battery and an LC oscillator circuit, and the battery being connected to the plurality of electromagnetic induction coils via the LC oscillator circuit.

BRIEF DESCRIPTION OF THE DRAWINGS

One or more embodiments are illustrated by way of example, and not by limitation, in the figures of the accompanying drawings, wherein elements having the same reference numeral designations represent like elements throughout. The drawings are not to scale, unless otherwise disclosed.

DETAILED DESCRIPTION

Details are given in the following description for better understanding of the present disclosure. However, the present disclosure may be implemented in a plurality of embodiments different from those described herein, and a person skilled in the art may make similar derivations without departing from the essence of the present disclosure. Therefore, the present disclosure is not subject to limitations by the specific embodiments of the present disclosure disclosed hereinafter.

With respect to the defects mentioned in the background, the present disclosure provides an atomizing device for an electronic cigarette and an electronic cigarette having the same. The present disclosure is described in detail hereinafter with reference to accompanying drawings and exemplary embodiments.

In the present disclosure, the atomizing device includes a housing and an electromagnetic induction heating device disposed in the housing; wherein the electromagnetic induction heating device generates heat based on the law of electromagnetic induction, and thus heats and bakes tobacco materials disposed therein. Therefore, the electromagnetic induction heating device includes electromagnetic induction coils generating a magnetic field, and induction heater generating heat under the effect of the magnetic field. However, the electromagnetic induction coils and the induction heater may be disposed in a plurality of manners. Description is given hereinafter with reference to three embodiments, and a person skilled in the art would make corresponding replacements or modifications based on these three exemplary embodiments.

Figure 1:
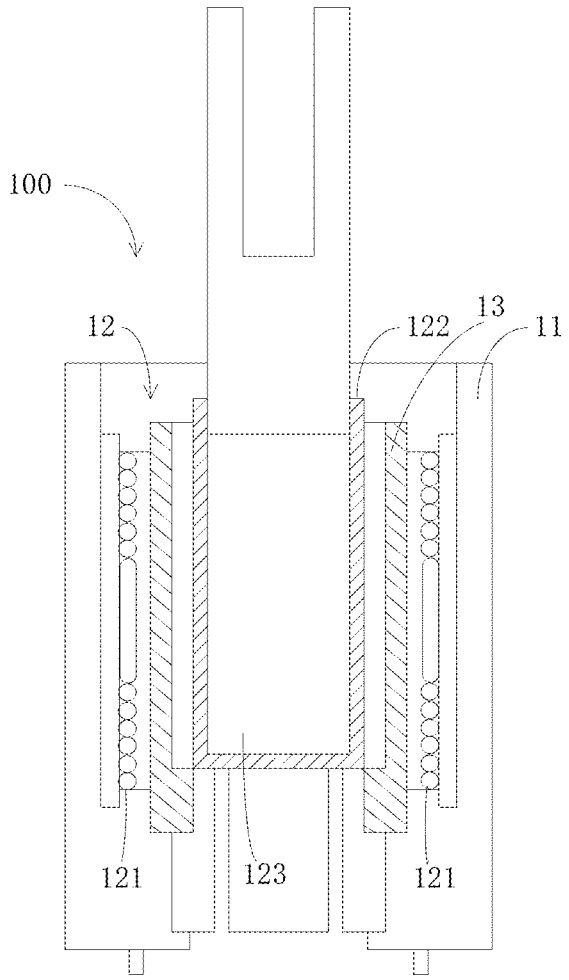
FIG. 1 is a schematic structural view of an atomizing device according to an embodiment of the present disclosure.

In an embodiment, referring to FIG. 1, FIG. 1 is a schematic structural view of an atomizing device 100 according to an embodiment of the present disclosure. The atomizing device 100 according to the embodiment includes a housing 11 and an electromagnetic induction heating device 12.

The shape of the housing 11 determines the appearance of the atomizing device 100. To simulate cigarettes, the housing 11 is typically disposed to have a cylindrical shape, and correspondingly the electromagnetic induction heating device 12 disposed in the housing 11 is also disposed to have an approximately cylindrical shape. Nevertheless, in the embodiment, the housing 11 may also be defined to a square shape or any other desired shapes. In addition, to prevent impacts caused by the electromagnetic induction heating device 12, the housing 11 is typically not made of a metal material. If the housing 11 is made of a metal material, an insulating material needs to be disposed between the housing 11 and the electromagnetic induction heating device 12.

The electromagnetic induction heating device 12 may be filled with tobacco materials. The electromagnetic induction heating device 12 generates heat based on the law of electromagnetic induction, heats and atomizes the tobacco materials and thus generates smoke, such that users smoke and feel as they are smoking real cigarettes.

In some exemplary embodiments, the electromagnetic induction heating device 12 includes a plurality of electromagnetic induction coils 121 and an induction heater 122. The electromagnetic induction coils 121 generate a magnetic field, such that the induction heater 121 generates a vortex under the effect of the magnetic field, and automatically and quickly generates heat to heat and bake tobacco materials. The induction heater 122 is made of a metal material.

In the embodiment of the present disclosure, the induction heater 122 defines a storage chamber 123, wherein the tobacco materials are filled in the storage chamber 123. The tobacco materials are in direct contact with the induction heater 122. When the induction heater 122 generates heat, the tobacco materials in the storage chamber 123 are directly heated. In the embodiment, the tobacco material may be tobaccos, cut tobaccos or tobacco liquids.

Figure 2:
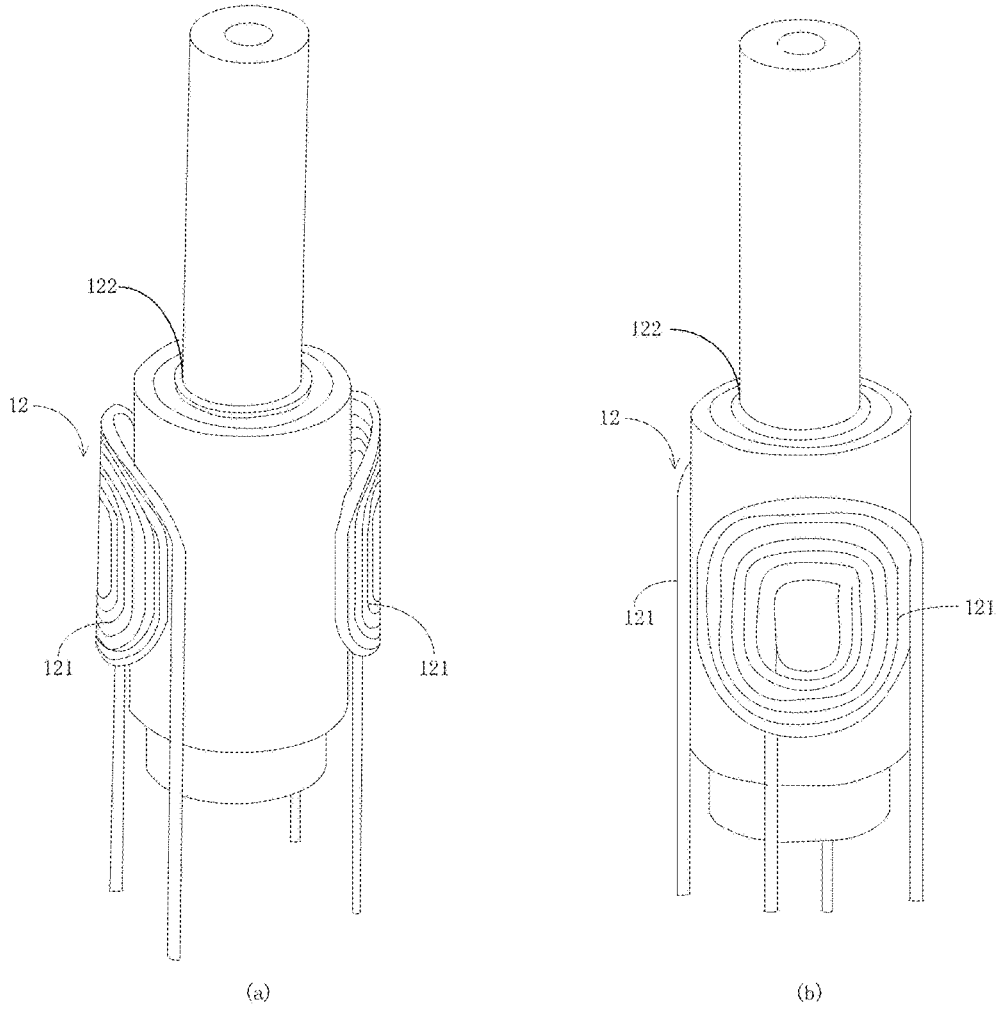
FIG. 2 is a schematic structural view of an electromagnetic induction heating device in the atomizing device shown in FIG. 1.

The electromagnetic induction coils 121 are disposed on the periphery of the induction heater 122, which may be referenced to FIG. 2. FIG. 2 is a schematic structural view of an electromagnetic induction heating device in the atomizing device shown in FIG. 1.

The electromagnetic induction coils 121 may be defined to any shape. In the embodiment, each of the electromagnetic induction coils 121 is defined to an arc-shaped sheet formed by bending planar coil, and the arc surface of the arc-shaped sheet is adaptive to the shape of the cylindrical-shaped induction heater 122. The arc-shaped electromagnetic induction coils 121 are disposed at a distance from the induction heater 122. The induction heater 122 is at the position with a higher magnetic field strength only when the electromagnetic induction coils 121 are spaced at a suitable distance from the induction heater 122, thereby improving the heating efficiency. In addition, when the electromagnetic induction coils 121 are disposed at a distance from the induction heater 122, the induction coils 121 are prevented from being damaged by the heat generated by the induction heater 122. In some exemplary embodiments, a heat insulating layer 13 may be further disposed between the electromagnetic induction coils 121 and the induction heater 122.

In FIG. 2(*a*), two electromagnetic induction coils 121 are employed and are symmetrically disposed, which may more uniformly heat the tobacco materials in the induction heater 122. Nevertheless, the electromagnetic induction coils 121 may be not symmetrically disposed, and specific disposal depends on the requirement of the shape of the electromagnetic induction heating device 12. In FIG. 2(*b*), four electromagnetic induction coils 121 are employed, and are respectively disposed along four directions of the periphery of the induction heater 122. FIG. 2(*b*) only illustrates two electromagnetic induction coils 121, and correspondingly two additional electromagnetic induction coils 121 are also disposed. It may thus be concluded that more electromagnetic induction coils 121 may be disposed in the electromagnetic induction heating device 12, which are uniformly disposed along a circumferential direction of the periphery of the induction heater 122. It may be understood that the plurality of electromagnetic induction coils 121 may also be disposed along an axial direction of the induction heater 122, and the electromagnetic induction coils may also be disposed based on a combination of these two arrangement modes.

Each of the electromagnetic induction coils 121 is independently connected to a circuit, such that each electromagnetic induction coil 121 is capable of independently controlling heat generation. When the plurality of the electromagnetic induction coils 121 are disposed along the circumferential direction of the periphery of the induction heater 122, and according to the actual needs, a part of the electromagnetic induction coils 121 may be controlled to operate, such that a part of the region on the periphery of the storage chamber 123 is heated. When the plurality of electromagnetic induction coils 121 are disposed along the axial direction of the induction heater 122, the tobacco materials in the storage chamber 123 may be heated segmentally according to the actual needs.

Figure 3:
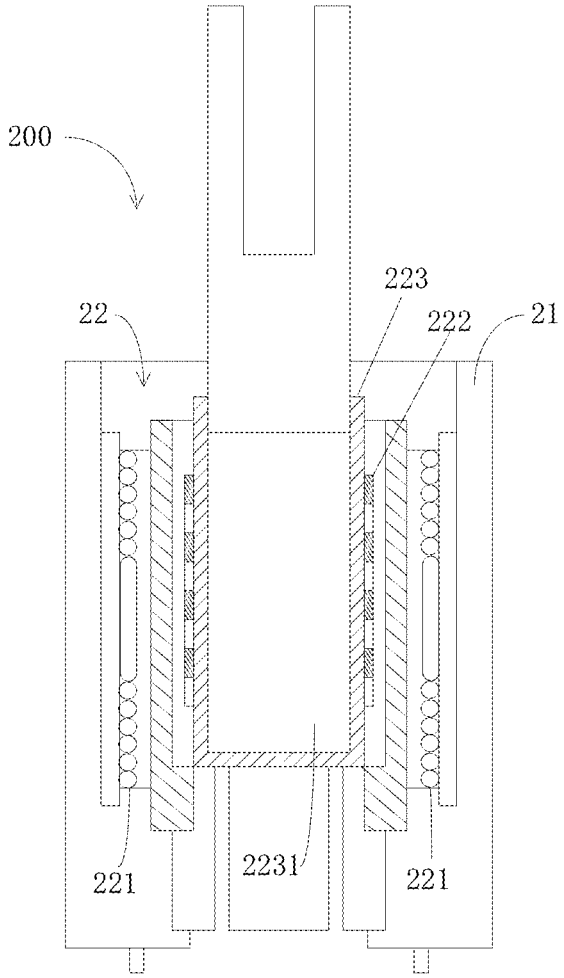
FIG. 3 is a schematic structural view of an atomizing device according to another embodiment of the present disclosure.

In another embodiment, referring to FIG. 3, FIG. 3 is a schematic structural view of an atomizing device 200 according to another embodiment of the present disclosure. In the embodiment, the atomizing device 200 includes a housing 21 and an electromagnetic induction heating device 22.

The atomizing device 200 in the embodiment is different from the atomizing device 100 mainly in that, in the embodiment, the electromagnetic induction heating device 22 includes a plurality of electromagnetic induction coils 221, an induction heater 222 and a frame 223.

The frame 223 defines a chamber 2231, wherein the tobacco materials are filled in the chamber 2231, and the induction heater 222 is disposed on the frame 223. In an exemplary embodiment, the induction heater 222 may be disposed on an outer surface of the frame 223, and is configured to conduct heat via the frame 223 to heat the tobacco materials. In another exemplary embodiment, the induction heater 222 may be disposed on an inner surface of the frame 223, and is in direct contact with the tobacco materials and heat the tobacco materials. In still another exemplary embodiment, the induction heater 222 may also be nested inside the frame 223 as a part of the frame 223, and is in direct contact with the tobacco materials and heat the tobacco materials. In further exemplary embodiment, the induction heater 222 may also be disposed within a body of the frame 223, and is configured to conduct heat via the frame 223 to heat the tobacco materials.

The plurality of electromagnetic coils 221 are disposed on the periphery of the frame 223. Therefore, the induction heater 222 disposed on the frame 223 may be disposed as to correspond to the electromagnetic induction coils 221. For example, if four electromagnetic induction coils 221 are employed in the embodiment, which are disposed in a way as illustrated in FIG. 2(*b*) and are respectively disposed at front, rear, left and right parts on the periphery of the frame 223, wherein four corresponding induction heaters 222 are employed and respectively disposed on the frame 223 and disposed still at the same front, rear, left and right parts.

In some exemplary embodiments, the induction heater 222 may also be disposed inside the chamber 2231, which may be mixed with the tobacco materials and filled into the chamber 2231 as small-size metals or metal powders, or may be disposed in the chamber 2231 as a cylindrical sleeve.

Figure 4:
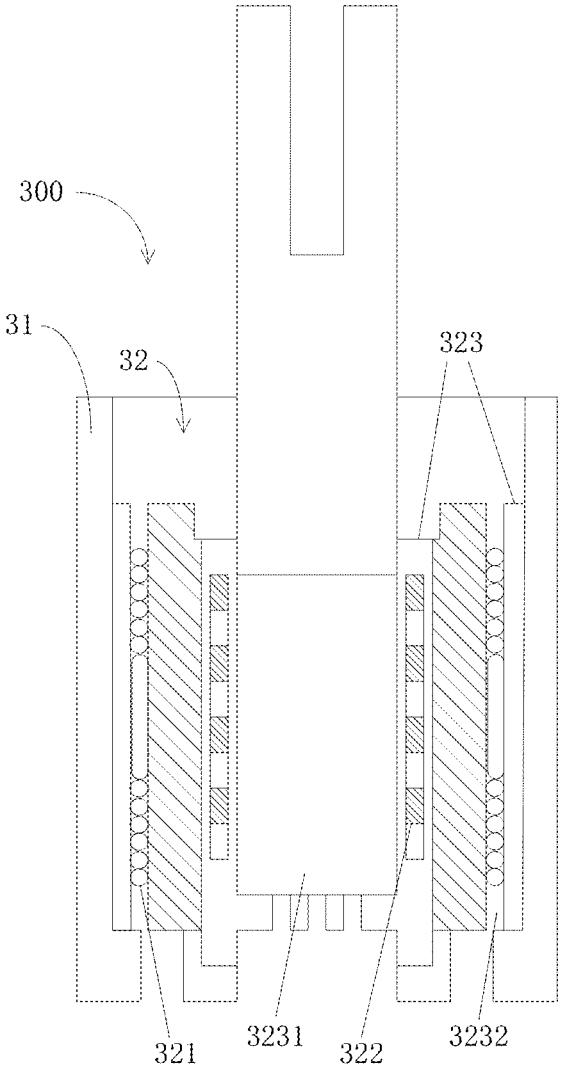
FIG. 4 is a schematic structural view of an atomizing device according to still another embodiment of the present disclosure.

In still another embodiment, referring to FIG. 4, FIG. 4 is a schematic structural view of an atomizing device 300 according to still another embodiment of the present disclosure. In the embodiment, the atomizing device 300 includes a housing 31 and an electromagnetic induction heating device 32. The electromagnetic induction heating device 32 includes a plurality of electromagnetic induction coils 321, an induction heater 322 and a frame 323.

The atomizing device 300 in the embodiment is different from the atomizing device 200 in that the frame 323 includes a first chamber 3231 and a second chamber 3232.

The tobacco materials are filled in the first chamber 3231, wherein the induction heater 322 is the same as the induction heater 222 in the aforesaid embodiment in terms of disposal. The induction heater 322 may be disposed in the first chamber 3231, or may be disposed on the periphery of the first chamber 3231. The electromagnetic induction coils 321 are disposed in the second chamber 3232, and surround the first chamber 3231, such that the electromagnetic induction coils 321 may surround the induction heater 322. In this way, the frame 323 may form an integral structure with the induction heater 322 and the electromagnetic induction coils 321.

In the embodiment, the electromagnetic induction coils 321 and the induction heater 322 may be integrated using the frame 323, wherein the electromagnetic induction heating device 32 is subjected to a modularized design such that the electronic cigarette having the atomizing device 300 is more simply to manufacture and install.

In addition, the electromagnetic induction coils 321 may be integrated with the induction heater 322 by means of ceramic sintering. In the embodiment of the present disclosure, the first chamber 3231 and the second chamber 3232 are not firstly formed. Instead, the electromagnetic induction coils 321 and the induction heater 322 are integrated by means of ceramic sintering, and are then packaged by the frame 323, such that the first chamber 3231 and the second chamber 3232 are automatically formed.

According to the above embodiments of the atomizing device, the atomizing device according to the present disclosure includes: a housing; and an electromagnetic induction heating device, disposed in the housing. The electromagnetic induction heating device includes a plurality of electromagnetic induction coils and an induction heater. The plurality of electromagnetic induction coils are disposed on the periphery of the induction heater. The induction heater is configured to generate a corresponding vortex in a magnetic field which is generated by the plurality of electromagnetic induction coils to heat and bake tobacco materials in the electromagnetic induction heating device. The atomizing device for an electronic cigarette according to the present disclosure employs a plurality of electromagnetic induction coils to heat, and has a high heating efficiency such that the tobacco materials are sufficiently decomposed.

Figure 5:
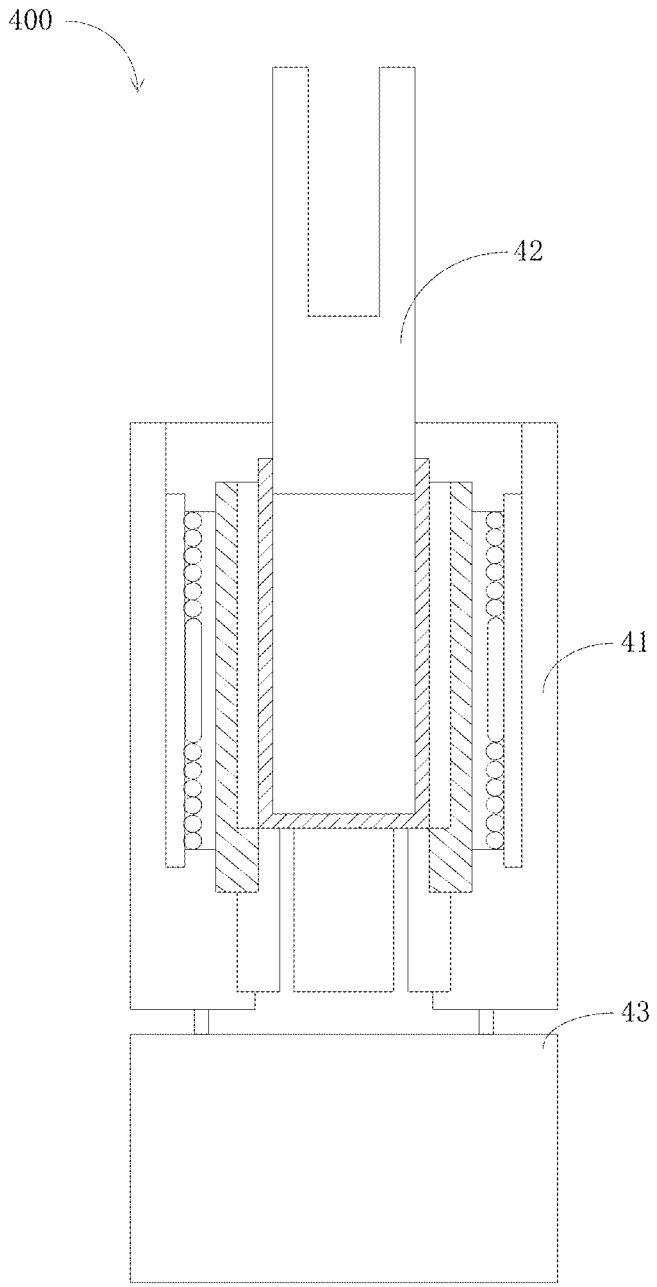
FIG. 5 is a schematic structural view of an electronic cigarette according to an embodiment of the present disclosure.
Figure 6:
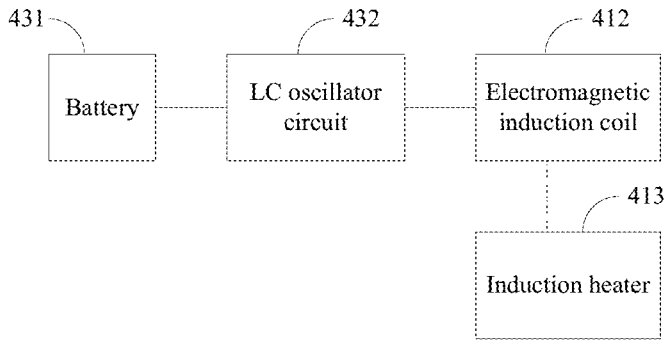
FIG. 6 is a schematic structural view of electrical connection between a power supply assembly and an atomizing device in the electronic cigarette shown in FIG. 5.
Figure 6:
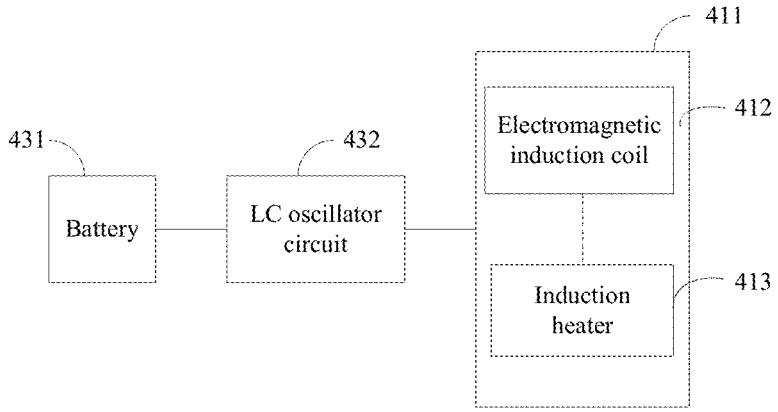

With respect to the applications of the atomizing device, reference may be made to FIG. 5 and FIG. 6. FIG. 5 is a schematic structural view of an electronic cigarette 400 according to an embodiment of the present disclosure. FIG. 6 is a schematic structural view of electrical connection between a power supply assembly and an Atomizing device in the electronic cigarette 400 in FIG. 5.

In the embodiment, the electronic cigarette 400 includes a power supply assembly 43 and an atomizing device 41 that are connected to each other. The power supply assembly 43 includes a battery 431 and an LC oscillator circuit 432. An electromagnetic inducting heating device 411 in the atomizing device 41 includes electromagnetic induction coils 412 and an induction heater 413.

The battery 431 is connected to the electromagnetic induction heating device 411 via the LC oscillator circuit 432, and supplies an alternating current for the electromagnetic induction coils 412.

In some exemplary embodiments, in FIG. 6(*a*), the atomizing device 41 is similar to the atomizing device 100 and the atomizing device 200. In the embodiment of the present disclosure, the battery 431 is directly connected to the electromagnetic induction coils 412 in the electromagnetic induction heating device 411 via the LC oscillator circuit 432.

In FIG. 6(*b*), the atomizing device is similar to the atomizing device 300, that is, the electromagnetic induction coils 412 and the induction heater 413 is modularized and packaged as the electromagnetic induction heating device 411. The electromagnetic induction heating device 411 has an electrical connection pin. The battery 431 is electrically connected to the electrical connection pin via the LC oscillator circuit 432, such that the battery 431 is electrically connected to the electromagnetic induction coils 412.

The electronic cigarette 400 is originally provided with a mouthpiece 42, which is disposed at an upper part of the tobacco materials. In this way, consumers may smoke the smoke via the mouthpiece 42, wherein the smoke is generated by baking the tobacco materials. Nevertheless, the mouthpiece 42 may also be detachably disposed on the housing of the atomizing device 41.

In the embodiment, the electronic cigarette has a high heating efficiency such that the tobacco materials are sufficiently decomposed.

Described above are exemplary embodiments of the present disclosure, but are not intended to limit the scope of the present disclosure. Any equivalent structure or equivalent process variation made based on the specification and drawings of the present disclosure, which is directly or indirectly applied in other related technical fields, fall within the scope of the present disclosure.

What is claimed is:

1. An electronic cigarette, comprising:

a power supply assembly and an atomizing device that are connected to each other; the atomizing device comprising:

a housing; and an electromagnetic induction heating device, disposed in the housing;

wherein the electromagnetic induction heating device comprises a plurality of electromagnetic induction coils and an induction heater, the plurality of electromagnetic induction coils being disposed on the periphery of the induction heater, the induction heater is configured to generate a corresponding vortex in a magnetic field which is generated by the plurality of electromagnetic induction coils, and the induction heater is configured to radiate heat from the periphery to heat and bake tobacco materials in the electromagnetic induction heating device;

wherein the power supply assembly comprises a battery and an LC oscillator circuit, the battery being connected to the plurality of electromagnetic induction coils via the LC oscillator circuit;

wherein the electromagnetic induction heating device further comprises a frame, the frame defines a first chamber and a second chamber, the first chamber is configured to be filled with the tobacco materials, and the plurality of electromagnetic induction coils are disposed in the second chamber and surround the first chamber, such that the frame, the electromagnetic induction coils and the induction heater form an integral structure.

2. The electronic cigarette according to claim 1, wherein each of the plurality of electromagnetic induction coils is an arc sheet which is formed by bending a planar coil, and wherein the plurality of electromagnetic induction coils surround the periphery of the induction heater, and are disposed at a distance from the induction heater.

3. The electronic cigarette according to claim 1, wherein a heat insulating layer is disposed between the electromagnetic induction coils and the induction heater.

4. The electronic cigarette according to claim 1, wherein the induction heater is disposed in the first chamber.

5. The electronic cigarette according to claim 4, wherein the induction heater is metallic particles or metal powder, which are/is mixed with the tobacco materials, wherein the metallic particles or metal powder and the tobacco materials are configured to be filled in the first chamber.

6. The electronic cigarette according to claim 1, wherein the induction heater is disposed on the frame, and is configured to conduct heat via the frame, such that the heat is radiated into the first chamber.

7. The electronic cigarette according to claim 1, wherein the plurality of electromagnetic induction coils are uniformly disposed along a circumferential direction of the periphery of the induction heater or disposed along an axial direction of the induction heater, and wherein each electromagnetic induction coil is independently connected to the power supply assembly.

8. An atomizing device for an electronic cigarette, comprising:

a housing; and an electromagnetic induction heating device, disposed in the housing;

wherein the electromagnetic induction heating device comprises a plurality of electromagnetic induction coils and an induction heater, the plurality of electromagnetic induction coils being disposed on the periphery of the induction heater, the induction heater is configured to generate a corresponding vortex in a magnetic field which is generated by the plurality of electromagnetic induction coils, and the induction heater is configured to radiate heat from the periphery to heat and bake tobacco materials in the electromagnetic induction heating device;

wherein the electromagnetic induction heating device further comprises a frame, the frame defines a first chamber and a second chamber, the first chamber is configured to be filled with the tobacco materials, the plurality of electromagnetic induction coils are disposed in the second chamber and surround the first chamber, such that the frame, the electromagnetic induction coils and the induction heater form an integral structure.

9. The atomizing device according to claim 8, wherein each of the plurality of electromagnetic induction coils is an arc sheet which is formed by bending a planar coil, and wherein the plurality of electromagnetic induction coils surround the periphery of the induction heater, and are disposed at a distance from the induction heater.

10. The atomizing device according to claim 8, wherein the plurality of electromagnetic induction coils are uniformly disposed along a circumferential direction of the periphery of the induction heater or disposed along an axial direction of the induction heater, and wherein each electromagnetic induction coil is independently connected to a circuit.

11. The atomizing device according to claim 8, wherein a heat insulating layer is disposed between the electromagnetic induction coils and the induction heater.

12. The atomizing device according to claim 8, wherein the induction heater is disposed in the first chamber.

13. The atomizing device according to claim 12, wherein the induction heater is metallic particles or metal powder, which are/is mixed with the tobacco materials, wherein the metallic particles or metal powder and the tobacco materials are configured to be filled in the first chamber.

14. The atomizing device according to claim 8, wherein the induction heater is disposed on the frame, and is configured to conduct heat via the frame, such that the heat is radiated into the first chamber.

* * * * *